US006158642A

United States Patent [19]

Herbage

[11] Patent Number: 6,158,642

[45] Date of Patent: Dec. 12, 2000

[54] MODULAR CARRIER ASSEMBLY ADAPTED FOR PAINTBALL

[76] Inventor: Charles Edward Herbage, 1102 Edgewood La., Cinnaminson, N.J. 08077

[21] Appl. No.: 09/473,412

[22] Filed: Dec. 28, 1999

[51] Int. Cl.[7] ..... A45F 5/00

[52] U.S. Cl. ..... 224/675; 224/665; 224/674; 224/684; 224/240; 224/901.8; 224/901.4

[58] Field of Search ..... 224/901.4, 901.8, 224/660, 665, 674, 675, 676, 682, 684, 240

[56] References Cited

U.S. PATENT DOCUMENTS

| | | | |
|---|---|---|---|
| D. 238,725 | 2/1977 | Zerobnck et al. . | |
| D. 335,070 | 4/1993 | Empie . | |
| D. 380,086 | 6/1997 | Brassard . | |
| D. 384,808 | 10/1997 | Carretta . | |
| D. 411,659 | 6/1999 | Karton . | |
| 1,530,342 | 3/1925 | Barber | 224/665 |
| 2,625,192 | 1/1953 | Kinskie | 224/665 |
| 4,029,243 | 6/1977 | Zerobnick et al. . | |
| 4,957,231 | 9/1990 | Kalisher | 224/901.8 X |
| 5,240,156 | 8/1993 | Sicotte et al. . | |
| 5,263,618 | 11/1993 | Talavera | 224/901.8 X |
| 5,413,262 | 5/1995 | Dewire et al. | 224/675 |
| 5,443,192 | 8/1995 | Hodges et al. | 224/674 X |
| 5,470,000 | 11/1995 | Munoz . | |
| 5,489,051 | 2/1996 | Robinson . | |
| 5,505,356 | 4/1996 | Noriega et al. . | |
| 5,570,824 | 11/1996 | Lyon et al. . | |
| 5,693,006 | 12/1997 | Slautterback . | |
| 6,003,744 | 12/1999 | Culjak | 224/674 X |

*Primary Examiner*—Gregory Vidovich
*Attorney, Agent, or Firm*—Mathews, Collins, Shepherd & Gould, P.A.

[57] ABSTRACT

A modular carrier assembly is disclosed which is adapted for use in playing the sport of paintball. The assembly includes a belt portion and a pack portion that are readily attachable and detachable to each other. The belt portion has a pack fastener adapted to mate with a belt fastener disposed on the pack; flaps on either the belt or the pack are inserted through straps on the other of the belt or the pack and secured to the belt. This configuration provides lumbar support to the user, enables the carrying of heavy weight, and allows for adjustments in the packs that can be carried.

18 Claims, 4 Drawing Sheets

MODULAR CARRIER ASSEMBLY ADAPTED FOR PAINTBALL

FIELD OF THE INVENTION

The present invention relates to a modular carrier assembly adapted for use in playing the sport of paintball. The assembly provides lumbar support to the user, enables the carrying of heavy weight, and allows for adjustments in the packs that can be carried.

BACKGROUND OF THE INVENTION

There are many sports in connection with which a participant may need or wish to carry articles, such as while hiking, skiing, or skating. In playing the sport of paintball, a carrier pack is a necessary item. In paintball, the participants are allocated to "sides" or teams. The teams run about a playing field and seek to "hunt" adverse team members and squirt them with paint from paintball guns. The players of this sport must carry cartridges of paint to refill their paintball guns while playing. The paint cartridges can be heavy. Thus, the carrier pack used for paintball should be sturdy, capable of carrying much weight, and provide good back support to the user. At the same time, it is important that the pack not interfere with the user's mobility and flexibility in the upper body and arms. Additionally, another consideration with paintball packs is that the players may want to carry differently-sized cartridges depending on the game and, therefore, adjust the packs they are carrying.

Consequently, it would be advantageous to have a pack that provides good back support, does not interfere with the user's mobility, and is adjustable for carrying different numbers or sizes of items. A wide variety of carrier packs have been patented showing a combination of packs with differently-sized compartments, or packs having supportive belts. See, for example, U.S. Pat. No. 5,693,006 to Slautterback, "Method of Using a Lifting Belt in Combination with an Accessory"; U.S. Pat. No. 5,240,156 to Sicotte et al, "Modular Component System"; U.S. Pat. No. 5,570,824 to Lyon et al., "Belt Pack and Support Therefor"; U.S. Pat. No. 5,505,356 to Noriega et al., "Detachable Article Holders"; U.S. Pat. No. 5,489,051 to Robinson, "Painter's Pouch"; U.S. Pat. No. 5,470,000 to Muñoz, Support Carrier Belt System"; U.S. Pat. No. 4,029,243 to Zerobnick et al., "Integrated Belt-Supported Backpack"; U.S. Pat. Des. 411,659 to Karton, "Multi-Pouch Fanny Pack," U.S. Pat. Des. 355,070 to Thiessen; U.S. Pat. Des. 384,808 to Carretta, "Sport Pack"; U.S. Pat. Des. 380,086 to Brassard, "Article Holder With Belf"; U.S. Pat. Des. 238,725 to Zerobnick, "Belt Pack."

However, in few of these cases are the packs truly "modular" meaning that the belt and the pack are readily detachable from one another so that the packs can be adjusted to carry differently-sized items at various times. In some cases, as in Lyon et al., straps can be undone from buckles and the packs removed from the belt so that a new pack can be rebuckled and strapped back onto the belt. However, unbuckling the straps can be cumbersome and time-consuming. A few packs have been described involving VELCRO™ attachments to attach and detach the compartments. See, e.g., Slautterback, Sicotte et al., and Muñoz. However, these latter packs are not adapted for use in carrying heavy items such as paintball cartridges.

As may be appreciated, there is a continuing need for a carrier assembly that is modular, provides good back support, and does not interfere with the user's mobility. Additionally, there is a continuing need for modular support and carrier assemblies for use in sports to provide the consumer with a choice of products.

SUMMARY OF THE INVENTION

Summarily described, the invention embraces a carrier assembly comprised of a belt portion and a pack portion that are readily attachable and detachable from each other. The belt has a pack fastener disposed thereon and first and second flaps extending outward in opposite directions from the pack fastener. The pack has at least one compartment which advantageously is adapted to hold a paint cartridge for playing the sport of paint ball. The pack also has a belt fastener adapted to mate with the pack fastener of the belt, and first and second straps disposed on opposite sides of the belt fastener. The belt and the pack can be releasably coupled together by the pack fastener being mated with the belt fastener, the free end of the first flap being inserted through the first strap and attached to the belt, and the free end of the second flap being inserted through the second strap and attached to the belt. Advantageously, one or more lumbar support pieces are disposed within the belt.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the invention and are not to scale.

DETAILED DESCRIPTION OF THE INVENTION

With this invention, a modular carrier assembly is provided that is useful in playing the sport of paintball. The assembly includes a belt and a pack that are readily detachable from one another so that different packs can be used and attached to the belt and differently-sized items can be carried at various times. The carrier assembly is sturdy, capable of carrying much weight, and provides good back support to the user. At the same time, when worn by a user the carrier assembly will not interfere with the user's mobility and flexibility in the upper body and arms.

Figure 1A:
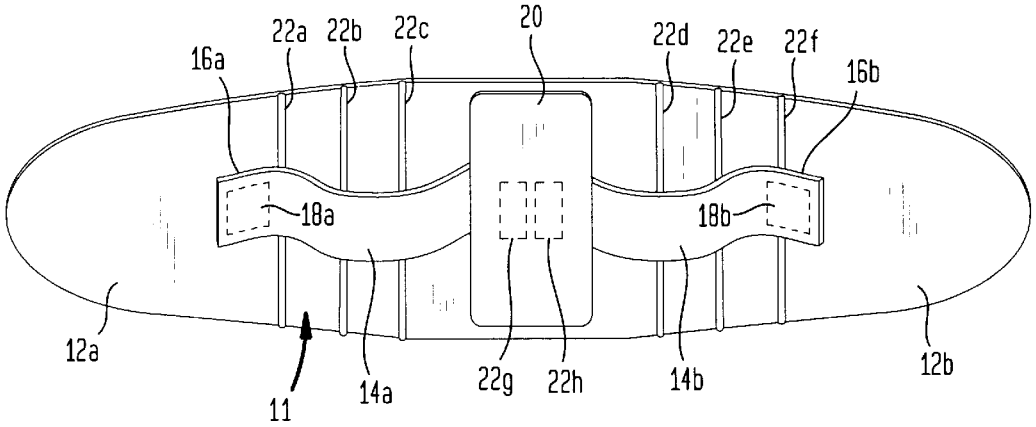
FIG. 1A schematically shows the exterior surface of the belt portion of the modular carrier assembly.
Figure 1B:
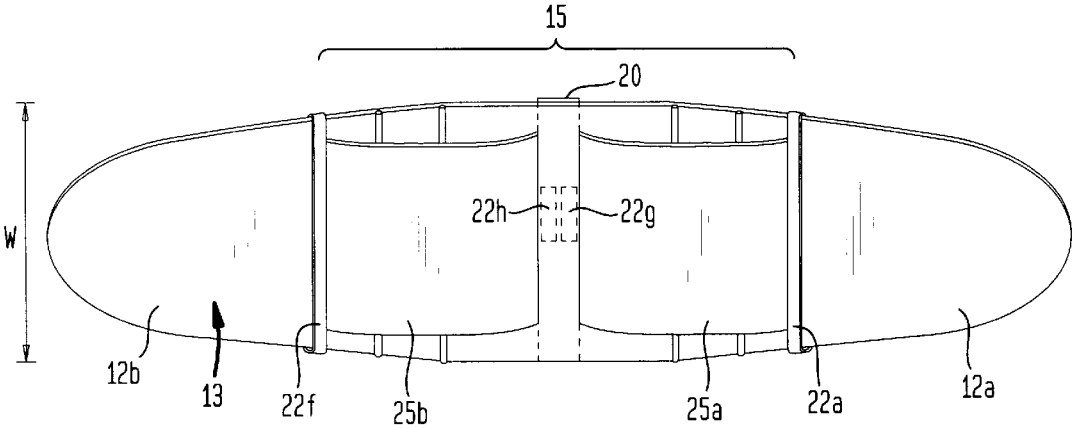
FIG. 1B schematically shows the interior surface of the belt portion of the modular carrier assembly.
Figure 2A:
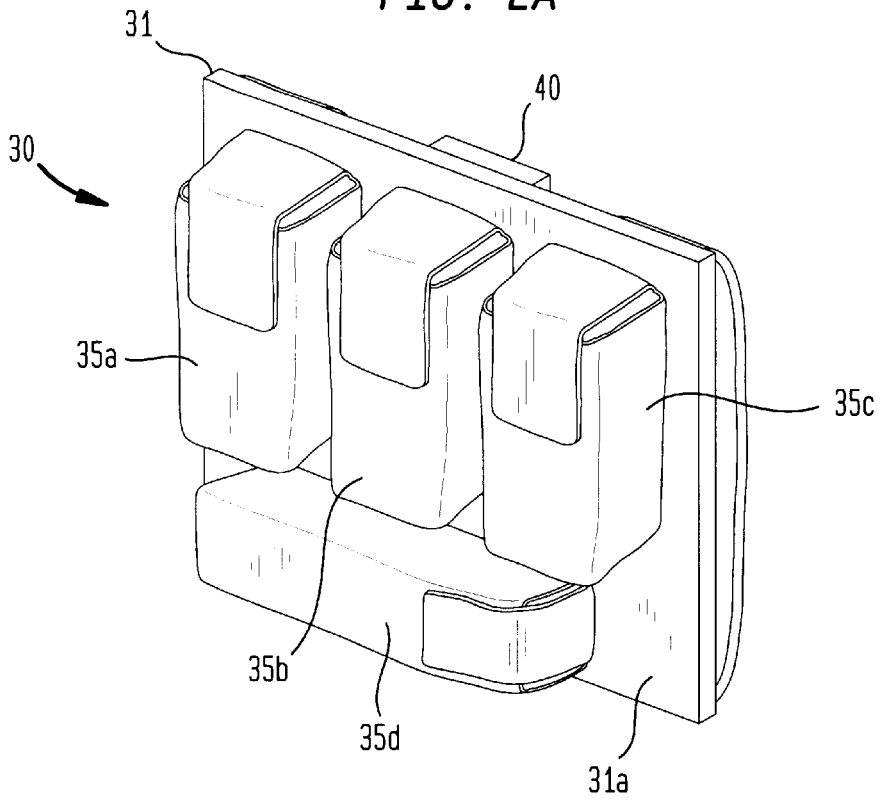
FIG. 2A schematically shows a first side of the pack portion of the modular carrier assembly.
Figure 2B:
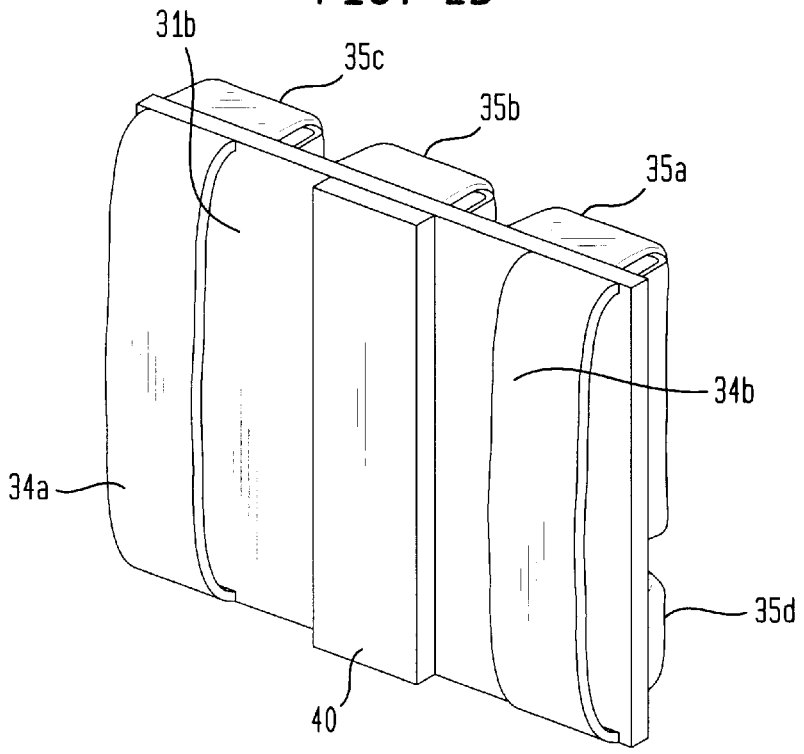
FIG. 2B schematically shows a second side of the pack portion of the modular carrier assembly.
Figure 3:
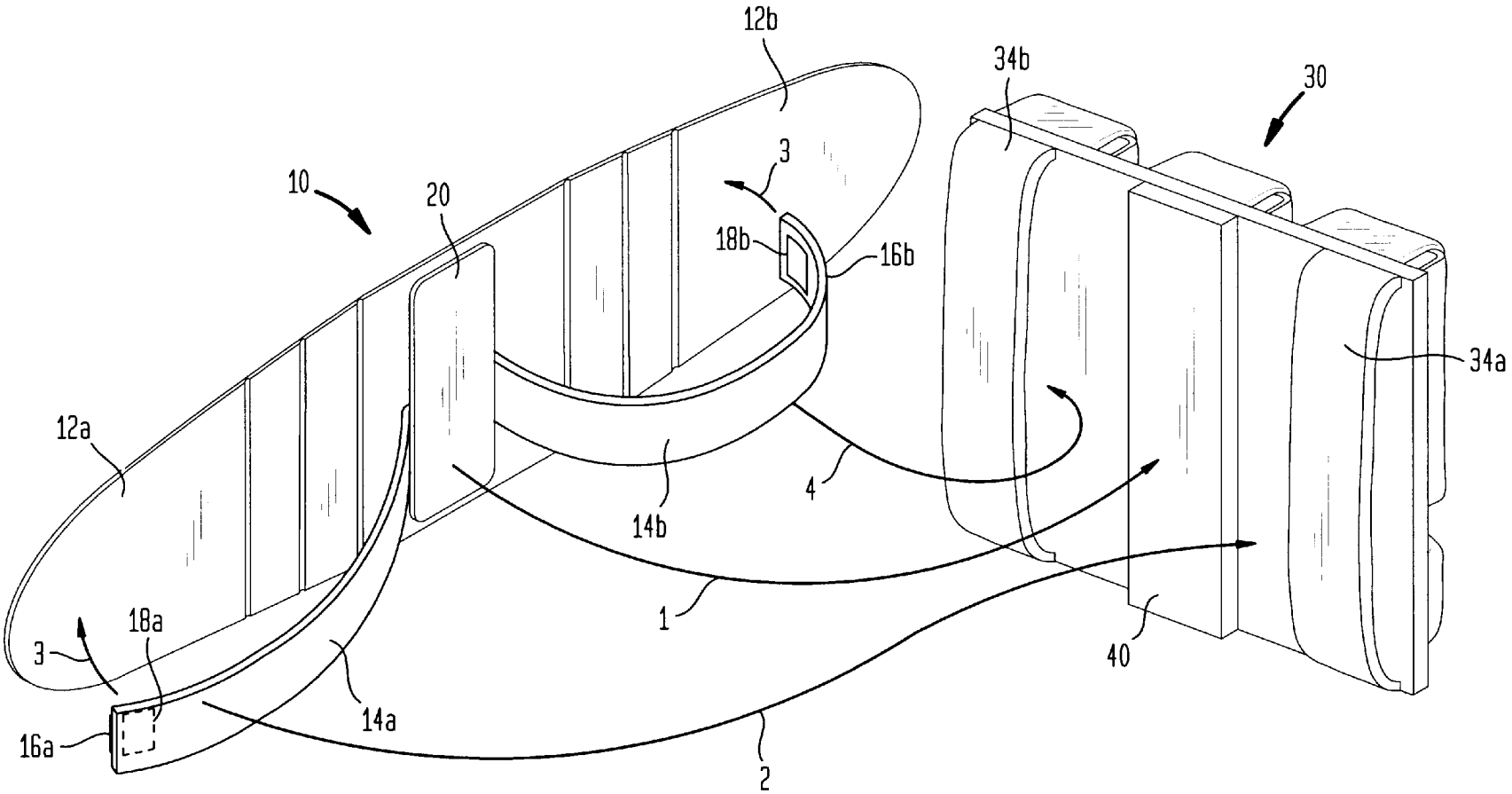
FIG. 3 schematically shows the belt and pack of FIGS. 1A–2B together with arrows indicating their assembly.

More particularly with reference to the figures, FIGS. 1A–1B show one embodiment of the belt portion 10 and FIGS. 2A–2B illustrate one embodiment of the pack portion 30 of the carrier assembly. The belt and pack are adapted to be readily attached and detached from each other as shown in FIG. 3. Looking first at FIGS. 1A–1B, there is shown the exterior surface 11 (FIG. 1A) and interior surface 13 (FIG. 1B) of the belt portion of the modular carrier assembly. The belt portion has a midsection 15 (FIG. 1B) and first and second end sections 12*a*, 12*b*, respectively. Advantageously, all or part of the midsection is made of an elastic or resilient material. A pack fastener 20 is located on the exterior surface of the belt which is adapted to mate with a belt fastener 40 on the second surface of the pack (FIG. 2B). Preferably, the pack fastener 20 is centrally disposed on the midsection between the two ends of the belt.

The belt advantageously comprises a lifting belt having a width "w" (FIG. 1B) at its widest section of about seven inches or more. Lumbar support may be provided by the width of the belt itself. Additionally, at least one, and preferably a plurality of, lumbar support pieces 22*a*, 22*b* . . . 22*h* may be disposed vertically on or within the belt. The lumbar support pieces are preferably substantially rigid pieces located in the belt at the midsection 15, which may include the junction of the midsection with the two end sections 12*a*, 12*b*. The lumbar support pieces may traverse the width of the belt, as shown with pieces 22*a*–22*f*, or they may cover only a section of the width of the belt, as shown with pieces 22*g*, 22*h*, outlined with hatched lines. Preferably, at least one substantially-rigid lumbar support piece is so disposed within the belt that when the belt is worn by the user, the lumbar piece is oriented along the user's lumbar region, e.g., centrally disposed within the belt. In that case, the pack fastener 20 may overly the lumbar support pieces 22*g*, 22*h*.

Advantageously, in providing lumbar support, at least one lateral support strip 25*a*, 25*b* is placed laterally on the interior surface of the belt at the midsection, e.g., from the area of the pack fastener 20 to the junction of the midsection 15 and two end sections. The lateral support strips are advantageously fabricated with elastic material. Although the belt is shown with two support strips 25*a*, 25*b* on either side of the pack fastener, of course other numbers of support strips may be used. For example, as opposed to the two wide support strips shown, four more narrow strips may be used, two on either side of the pack fastener 20.

A first 14*a* and a second flap 14*b* may extend in opposite directions outward from the belt fastener. The first and second flaps each have a free end 16*a*, 16*b*, and an interior surface that faces the belt. The free ends 16*a*, 16*b* are configured so that they can be attached to the first 12*a* and second 12*b* end sections of the belt. Advantageously this is accomplished by flap fasteners being disposed on the interior surfaces of each of the flaps proximal their free ends to define a first flap fastener 18*a* and a second flap fastener 18*b*. The first and second end sections may have flap "retainers" disposed thereon for holding the free ends of the flaps to the belt. The first and second flap fasteners and first and second flap retainers, as well as the belt and pack fasteners, advantageously comprise VELCRO™ loop and hook tape.

Looking now at FIGS. 2A–2B, there are shown views of the pack portion 30 of the modular carrier assembly from first and second sides, respectively. The pack is comprised of a plane piece 31 having a first surface 31*a* and a second surface 31*b*. The first surface has disposed thereon at least one and preferably a plurality of compartments 35*a*, 35*b*, 35*c*, 35*d*. Advantageously, each one of the plurality of compartments is adapted to hold at least one paint cartridge for use in playing the sport of paintball, thereby providing a modular carrier assembly adapted for use in paintball. The second side surface has a belt fastener 40 thereon which is adapted to mate with the pack fastener. Thus, preferably the belt fastener is centrally disposed on the plane piece 31. A first strap 34*a* and a second strap 34*b* are shown located on the pack on opposite sides of the pack fastener 40.

FIG. 3 shows assembly of the belt 10 and pack 30 portions of the carrier assembly. As shown in FIG. 3, the pack and the belt can be releasably coupled together by the pack fastener 20 being mated with the belt fastener 40, following arrow "1." To provide greater support in carrying heavy articles, such as paint cartridges, the free end 16*a* of the first flap 14*a* is inserted through the first strap 34*a*, following "2." Then, the free end 16*a* is secured to the first end section 12*a* of the belt, by first flap fastener 18*a* being secured to a flap "retainer" on the first end section 12*a*, following arrow "3." The free end 16*b* of the second flap 14*b* is inserted through the second strap 34*b*, following arrow "4," and the second flap fastener 18*b* is mated to the second flap retainer on the second end section 12*b*, following arrow 3'. With this configuration, a secure hold is provided such that heavy articles can be carried without the pack detaching during use from the belt.

Figures 4, 5:
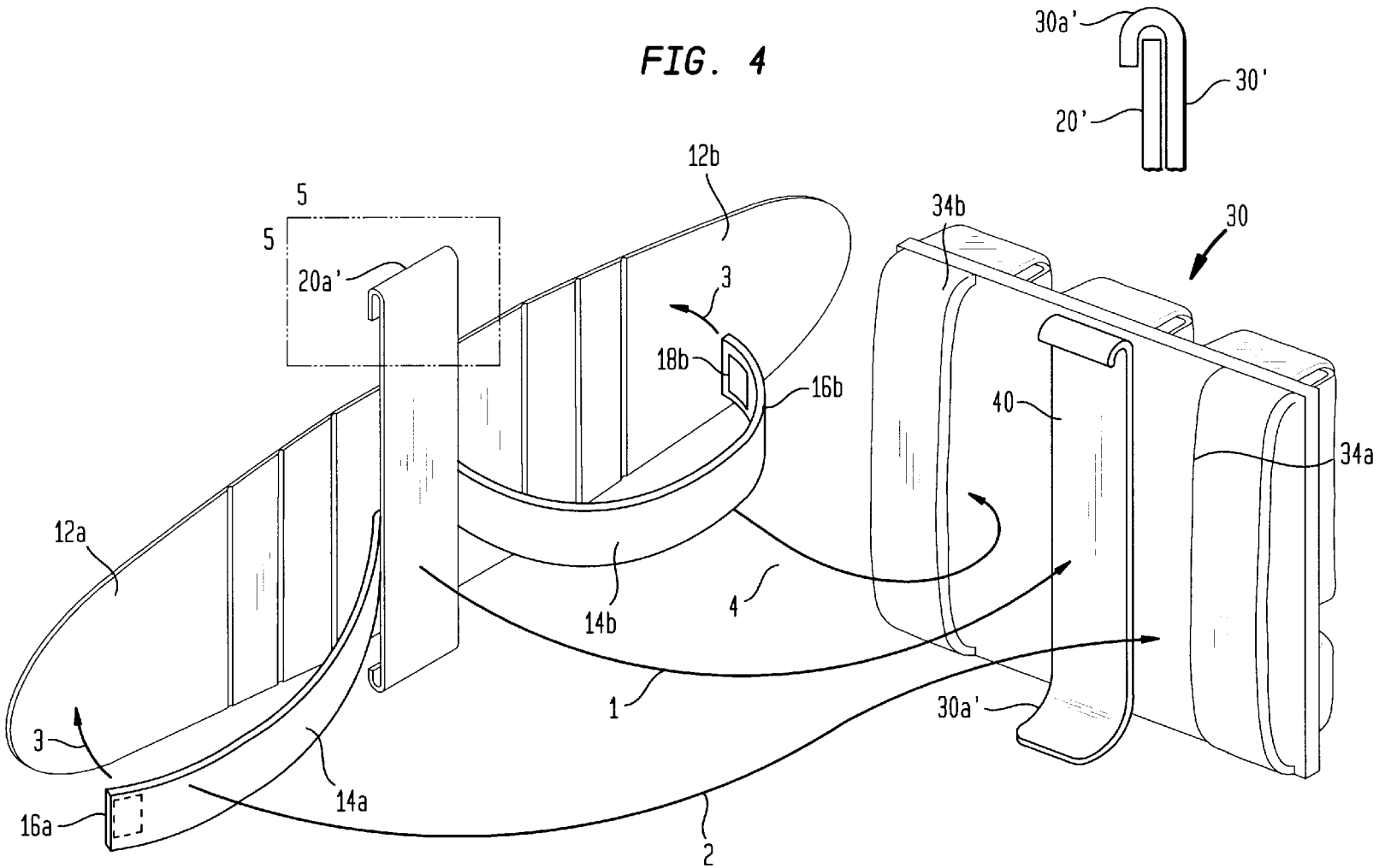
FIG. 4 schematically shows an alternative embodiment of the belt and pack together with arrows indicating their assembly.
FIG. 5 is a partial cut-away side view of the embodiment of FIG. 4, when assembled, taken at boxed region 5—5 of FIG. 4.

FIG. 4 shows an alternative embodiment of the carrier assembly. In this embodiment, a centrally-disposed lumbar support piece 22*i* is provided on the belt. This lumbar support piece extends vertically beyond the periphery of the belt, as shown. Also, the pack fastener 20' is disposed on the exterior surface of the lumbar support piece, and thus, it extends vertically beyond the periphery of the belt. Also, the pack fastener at 20*a*' is partially disposed on the interior surface of the lumbar support piece. The belt fastener 30' here is of sufficient length that it can be mated with the pack fastener on the exterior surface of the support piece and also wrapped around the belt to mate with the pack fastener on the interior surface of the support piece. In FIG. 4, this is accomplished with a length 30*a*' of the belt fastener extending beyond the periphery of the pack. FIG. 5, for example, shows a partial cut-away side view of the embodiment of FIG. 4, when assembled, taken at boxed region 5—5 of FIG. 4. As can be seen, a portion 30*a*' of the belt fastener wraps around the pack fastener to bind with the interior surface of the pack fastener. This wrapping around of the belt fastener provides further support for carrying heavy articles. Also, the extended length of the lumbar support (e.g., 22*i*) provides additional back support to the user.

Naturally, the belt portion is secured around the waist of a user. This may be accomplished using buckling mechanisms known in the field. Also, a piece of VELCRO™ loop and hook tape may be attached to the interior surface of the belt adjacent one end section to define a buckling part 19. In this way, when the belt is wrapped around the user's waste, the buckling part 19 may be secured to the exterior surface of the belt adjacent the other end (e.g., shown as 12*a* in FIG. 4).

It is understood that the embodiments described herein are merely exemplary and that a person skilled in the art may make variations and modifications without departing from the spirit and scope of the invention. For example, although the invention is illustrated with reference to an assembly for holding paint cartridges while playing paintball, it may be applied to other sports. Also, although the invention is shown with the flaps 14*a*, 14*b* disposed on the belt portion of the assembly and the straps 34*a*, 34*b* on the pack portion, alternatively the flaps may be placed on the pack and the straps on the belt. All such variations and modifications are intended to be included within the scope of the appended claims.

I claim:

1. A modular carrier assembly comprising:

a belt having an exterior and interior surface, a first and a second end, a pack fastener centrally disposed on the exterior surface of the belt between the first and second ends, a first and a second flap extending outward in opposite directions from the pack fastener, the first flap having a free end configured to be attached to the belt adjacent the first end and the second flap having a free end configured to be attached to the belt adjacent the second end, a pack including a plane piece having a first and a second surface, at least one compartment on the first surface of the plane piece, and a belt fastener on the second surface of the plane piece adapted to mate with the pack fastener of the belt, the pack further having a first and a second strap disposed on the second surface thereof on opposite sides of the belt fastener;

wherein the belt and the pack are selectively releasably coupled together by the pack fastener being mated with the belt fastener, the free end of the first flap being inserted through the first strap and attached to the belt adjacent the first end, and the free end of the second flap being inserted through the second strap and attached to the belt adjacent the second end.

2. The modular carrier assembly of claim 1 in which the belt has a midsection and two end sections, wherein the midsection is fabricated with an elastic material.

3. The modular carrier assembly of claim 2, further comprising at least one elastic support strip placed laterally on the interior surface of the belt at the midsection for providing lumbar support to the user.

4. The modular carrier assembly of claim 1, further comprising at least one substantially rigid lumbar support piece disposed vertically within the belt.

5. The modular carrier assembly of claim 1, in which the first and second flaps each have an interior surface for facing the belt with a flap fastener on the interior surface thereof to define a first and second flap fastener, and the belt has adjacent the first and second ends thereof a first and a second flap retainer adapted to mate with the first and second flap fasteners, respectively.

6. The modular carrier assembly of claim 5, in which the first and second flap fasteners and first and second flap retainers are fabricated with loop and hook tape.

7. The modular carrier assembly of claim 1, in which the pack fastener and belt fastener are fabricated with loop and hook tape.

8. The modular carrier assembly of claim 1 in which a plurality of compartments are located on the first surface of the plane piece, each one of the plurality of compartments being configured to retain at least one paint cartridge for use in the sport of paintball.

9. The modular carrier assembly of claim 1, further comprising a substantially-rigid lumbar support piece so disposed within the belt that when the belt is worn by the user, the lumbar piece is oriented along the user's lumbar region.

10. The modular carrier assembly of claim 9, wherein the lumbar support piece is centrally disposed within the belt between the first and second ends such that the pack fastener is oriented on the belt overlying the lumbar support piece.

11. The modular carrier assembly of claim 1, further comprising a substantially rigid lumbar support piece disposed on the belt such that the support piece extends vertically beyond the periphery of the belt, the pack fastener being disposed over an exterior surface of the support piece and also partially disposed over an interior surface of the support piece which extends vertically beyond the periphery of the belt, and wherein the belt fastener is of sufficient length that it is selectively mated with the pack fastener on the exterior and interior surfaces of the support piece.

12. A modular carrier assembly adapted to hold a plurality of paint cartridges for playing the sport of paintball, the assembly comprising:

a lifting belt having a midsection and first and second end sections, an exterior and interior surface, at least one lumbar support piece between the first and second end sections, and a pack fastener centrally disposed on the exterior surface of the belt between the first and second end sections, a pack including a plane piece having a first and a second surface, a plurality of compartments on the first surface of the plane piece wherein each one of the plurality of compartments is adapted to hold at least one paint cartridge, and a belt fastener on the second surface of the plane piece adapted to mate with the pack fastener of the belt, a first and a second strap disposed on one of the exterior surface of the belt and the second surface of the pack, and a first and second flap extending outward from the belt fastener or the pack fastener of the other of the second surface of the pack and the exterior surface of the belt, in which the first flap is configured to be inserted through the first strap and secured to the other of the second surface of the pack and the exterior surface of the belt and the second flap is configured to be inserted through the second strap and secured to the other of the second surface of the pack and the exterior surface of the belt.

wherein the belt and the pack are selectively releasably coupled together by the pack fastener being mated with the belt fastener, the first flap being inserted through the first strap and attached to the other of the second surface of the pack and the exterior surface of the belt, and the second flap being inserted through the second strap and attached to the other of the second surface of the pack and the exterior surface of the belt.

13. The modular carrier assembly of claim 12 in which the midsection is fabricated with an elastic material.

14. The modular carrier assembly of claim 13, in which the first and second end sections are fabricated with hook or loop tape and the first and second flaps are disposed on the exterior surface of the belt and each have an interior surface for facing the belt with a hook or loop tape on the interior surface thereof adapted to mate with the hook or loop tape on the first and second end sections, respectively.

15. The modular carrier assembly of claim 14 further comprising at least one elastic support strip placed laterally on the interior surface of the belt at the midsection for providing lumbar support to the user.

16. The modular carrier assembly of claim 12, comprising a plurality of substantially rigid lumbar support pieces disposed vertically within the belt.

17. A modular carrier assembly adapted for holding a plurality of paint cartridges for use in playing the sport of paintball, comprising:

a belt having an exterior and interior surface, a first and a second end section, an elastic midsection between the first and second end sections, a lumbar support so disposed at the midsection of the belt that when the belt is worn by a user the lumbar support is oriented along the user's lumbar region, a pack fastener on the exterior surface of the belt overlying the lumbar support, the belt further having a first flap retainer on the exterior surface of the belt at the first end section and a second flap retainer on the exterior surface of the belt at the second end section;

a pack having a plane piece, a plurality of compartments on the plane piece, each one of the plurality of compartments being adapted to hold at least one of the plurality of paint cartridges, and a belt fastener adapted to mate with the pack fastener;

a first and a second strap on the pack, the first and second strap being oriented so they are disposed on opposite sides of the lumbar support when the pack is mated to the belt;

a first and a second flap extending in opposite directions outward from the pack fastener, the first and second flaps each having a free end, an interior surface for facing the belt, and a flap fastener on the interior surface proximal the free end thereof to define a first flap fastener and a second flap fastener, wherein the pack and the belt are selectively releasably coupled together by the pack fastener being mated with the belt fastener, the free end of the first flap being inserted through the first strap, the first flap fastener being mated to the first flap retainer, the free end of the second flap being inserted through the second strap, and the second flap fastener being mated to the second flap retainer.

18. The modular carrier assembly of claim 17, in which the lumbar support and pack fastener extend vertically beyond the periphery of the belt, the pack fastener being disposed on the exterior surface of the lumbar support and also partially disposed on the interior surface of the lumbar support, and wherein the belt fastener is of sufficient length that it is selectively mated with the pack fastener on the exterior surface of the lumbar support and also wrapped around the lumbar support to mate with the pack fastener on the interior surface of the lumbar support.

* * * * *